US006080022A

United States Patent [19]

Shaberman et al.

[11] Patent Number: 6,080,022

[45] **Date of Patent: *Jun. 27, 2000**

[54] MULTIVOLTAGE KEYED ELECTRICAL CONNECTOR

[75] Inventors: Anthony J. Shaberman, Roseville, Calif.; Michael Sean Casey, Singapore, Singapore

[73] Assignee: Intel Corporation, Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/672,643

[22] Filed: Jun. 28, 1996

[51] Int. Cl.[7] ..... H01R 13/64

[52] U.S. Cl. ..... 439/680; 439/488; 361/90; 361/115

[58] Field of Search ..... 439/680, 633, 439/681, 218, 222, 488, 489; 361/90, 115

[56] References Cited

U.S. PATENT DOCUMENTS

| | | | |
|---|---|---|---|
| 3,404,316 | 10/1968 | Jacobs | 361/635 |
| 3,614,714 | 10/1971 | Silverstein | 439/633 |
| 3,818,280 | 6/1974 | Smith et al. | 439/633 |
| 5,044,994 | 9/1991 | Van Woensel | 439/681 |
| 5,421,734 | 6/1995 | MacWilliams | 439/633 |

OTHER PUBLICATIONS

Selected pages from the PCMCIA/JEIDA PC Card Standard, Feb. 1995, (7 pgs. total).

*Primary Examiner*—Gary F. Paumen
*Assistant Examiner*—Briggitte R. Hammond
*Attorney, Agent, or Firm*—Blakely, Sokoloff, Taylor & Zafman LLP

[57] ABSTRACT

A connection system for providing a consumer-friendly connection between an expansion card and a host device. The host device includes a male connection while the expansion card includes a female connection. The male and female connections are arranged in a pattern that allows a combination of keyed voltage connections between the host device and expansion card when the supply voltage of the host and operating voltage of the card are compatible. The male connection includes six different supply voltage combinations that include a first voltage only, a second voltage only, a third voltage only, a first and second voltage only, a second and third voltage only, and a first, second and third voltage combination. In addition, the female connection includes six different expansion card operating voltage combinations that include a first voltage only, a second voltage only, a third voltage only, a first and second voltage only, a second and third voltage only, and a first, second and third voltage combination.

12 Claims, 6 Drawing Sheets

| HOST VOLTAGE KEY | 5v | 5v/3.3v | 3.3v | 3.3v/x.xv | x.xv | 5v/3.3v/x.xv |
|---|---|---|---|---|---|---|
| CARDS ACCEPTED | 5v/3.3v/x.xv<br>5v<br>5v/3.3v | 5v/3.3v/x.xv<br>5v<br>5v/3.3v<br>3.3v<br>3.3v/x.xv | 5v/3.3v/x.xv<br>5v/3.3v<br>3.3v<br>3.3v/x.xv | 5v/3.3v/x.xv<br>5v/3.3v<br>3.3v<br>3.3v/x.xv<br>x.xv | 5v/3.3v/x.xv<br>3.3v/x.xv<br>x.xv | 5v/3.3v/x.xv<br>5v<br>5v/3.3v<br>3.3v<br>3.3v/x.xv<br>x.xv |

FIGURE 5

MULTIVOLTAGE KEYED ELECTRICAL CONNECTOR

FIELD OF THE INVENTION

The present invention relates to keyed connectors and more particularly to a keyed connection system that prohibits the insertion of an expansion memory card into a host device when the expansion card power voltage is incompatible with the host device power voltage.

BACKGROUND OF THE INVENTION

With the introduction of notebook computers and other portable devices utilizing battery power, electronic circuits in the device are required to utilize as little power as possible to preserve the batteries for an extended period of time. Even with devices that are not battery powered it is desirable to have electronic circuits that operate with as little power consumption as possible to conserve energy. Direct current (DC) power consumption in electronic devices can be approximated by the equation P=VI whereas alternating current (AC) power consumption can be approximated by the equation $CV^2F$. Thus power consumption is proportional to the voltage supply V or the square of the voltage supply $V^2$. In either case, power consumption can be decreased by lowering the voltage power supply. For example, the decrease in DC supply voltage from 5.0 volts to 3.3 volts will approximately decrease power consumption by over forty percent. With the increase of portable electronic and battery operated devices the power consumption and operational time of the portable units has become important. Although most electronic components currently utilize 5.0 volt and 3.3 volt component technology, the trend is toward developing electronic components that operate at a voltage of lower than 3.3 volts. The development and implementation of process technology based on a voltage of less than 3.3 volts promises significant power savings in future systems.

Many electronic components used by the typical consumer require the use of some form of electronic data storage. For example, consumer devices such as handheld PCs, digital cameras, audio recorders, smart cellular phones, etc., require a small form factor data storage media, and a convenient method for transporting data to a PC or other electronic device for manipulation or enhancement. Small form factor expansion memory cards supporting a variety of technologies (e.g. Flash, Read-Only-Memory ("ROM"), One-Time Programmable Read-Only Memory ("OTPROM"), Electrically Erasable Programmable Read-Only Memory ("EEPROM"), Dynamic Random Access Memory ("DRAM") and Static Random Access Memory ("SRAM")) have been developed to support the electronic transfer of data from one electronic device to another. In order to facilitate the movement towards reducing the power consumption of portable electronic components, it is desirable to provide memory cards that are compatible with a system voltage of less than 3.3 volts. It is important to note, however, that in some instances it may be desirable or necessary to use a memory card that is capable of operating at one or more voltages. In any event, it is necessary to provide a memory card that is compatible with the supply voltage provided by a single voltage or multivoltage host system.

Since a host device and/or memory card may be designed to operate at 5.0 volts, 3.3 volts, at a voltage of less than 3.3 volts, or any voltage combination thereof, it is desirable to provide a connection system that will accommodate the electrical connection between such components. Mismatching the power supply of a memory card with that of a host device can cause damage to data stored in the memory card and may result in damage to the memory card itself.

Many prior art memory cards utilize voltage detection circuits that inhibit the operation of a memory card when the memory card operating voltage is incompatible with the host device supply voltage. Although the use of a voltage detection circuit is useful in preventing damage to data stored in a memory card, the voltage detection circuit does not prevent the insertion of a memory card into an incompatible host. Because many portable electronic devices are used by consumers who are typically unaware of the particular operating voltage of the devices they operate, the ability to physically connect a memory card and host device having incompatible voltages can be problematic. For instance, the user of a digital camera who is hoping to capture the birth of a child may be particularly unforgiving when he or she discovers that the image was not recorded because the memory card operating voltage was incompatible with the host device supply voltage.

SUMMARY OF THE INVENTION

It is an object of the invention to provide a keying mechanism that protects an expansion card from improper socket insertion, supports multivoltage hosts and cards, and resolves potential incompatibility issues for the consumer. The invention providing a voltage keyed connection system connecting an expansion card and a host device is disclosed. The host device includes a male connection while the expansion card includes a female connection. The male and female connections are arranged in a pattern that allows a combination of keyed voltage connections between the host device and expansion card when the supply voltage of the host and operating voltage of the card are compatible.

BRIEF DESCRIPTION OF THE DRAWINGS

The present invention is illustrated by way of example and is not limited by the figures of the accompanying drawings, in which like references indicate similar elements, and in which:

FIG. 5 shows a table of the possible voltage connection combinations in one embodiment of the present invention.

DETAILED DESCRIPTION

In one embodiment of the present invention an overlapping keying mechanism is provided that prevents an expansion card from being inserted into host systems that do not support the operating voltage of the card. The keying mechanism protects the card from improper socket insertion, supports multivoltage hosts and cards, and resolves potential incompatibility issues for the consumer.

Figure 1:
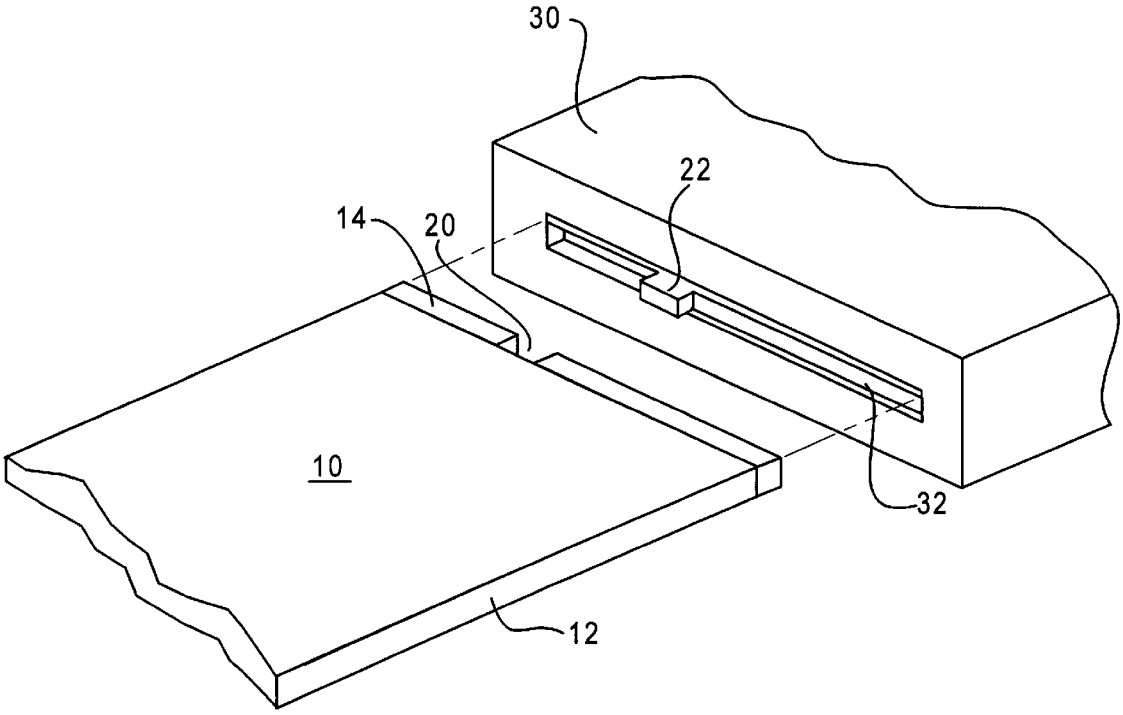
FIG. 1 is a perspective view of an expansion card connector interface and host device socket in one embodiment of the invention.

FIG. 1 illustrates a perspective view of an expansion card 10. Inside the plastic case 12 of expansion card 10 there are a plurality of memory devices (not shown) for storing data. Expansion card 10 is inserted into a slot or socket 32 of a host device 30 for a memory read or write operation.

Card 10 includes a connector 14 located along one side of the card to connect card 10 to host device 30 when the connector is inserted into a slot defining a socket 32. It is appreciated that host device 30 may include a portable computer, a digital camera, an audio device, a smart cellular phone, or any other type of computer or electronic device. As shown in FIG. 2A, in one embodiment a plurality of electrical contacts 16 are positioned along the bottom side 34 of card 10. Contacts 16 are used to provide power from host device 30 to card 10 and to facilitate the transmission of signals between the host device and card. Electrical contacts may also be housed within connector 14.

As previously discussed, there is a trend in the electronic industry to move battery operated devices to lower operating voltages for power saving purposes. As a result, system platform voltages have migrated from 5.0 volts to 3.3 volts and are expected to drop to a third voltage in the range of approximately 1.8 to 2.8 volts. Host device systems need to be able to handle these different voltage levels for insertable devices. Some host systems will be designed to operate at multiple voltages, and should be able to handle cards with different operating voltages. In accordance with one embodiment of the present invention, an overlapping keying mechanism is provided that prevents a card from being inserted into a host that does not support the operating voltage of the card.

Figure 3:
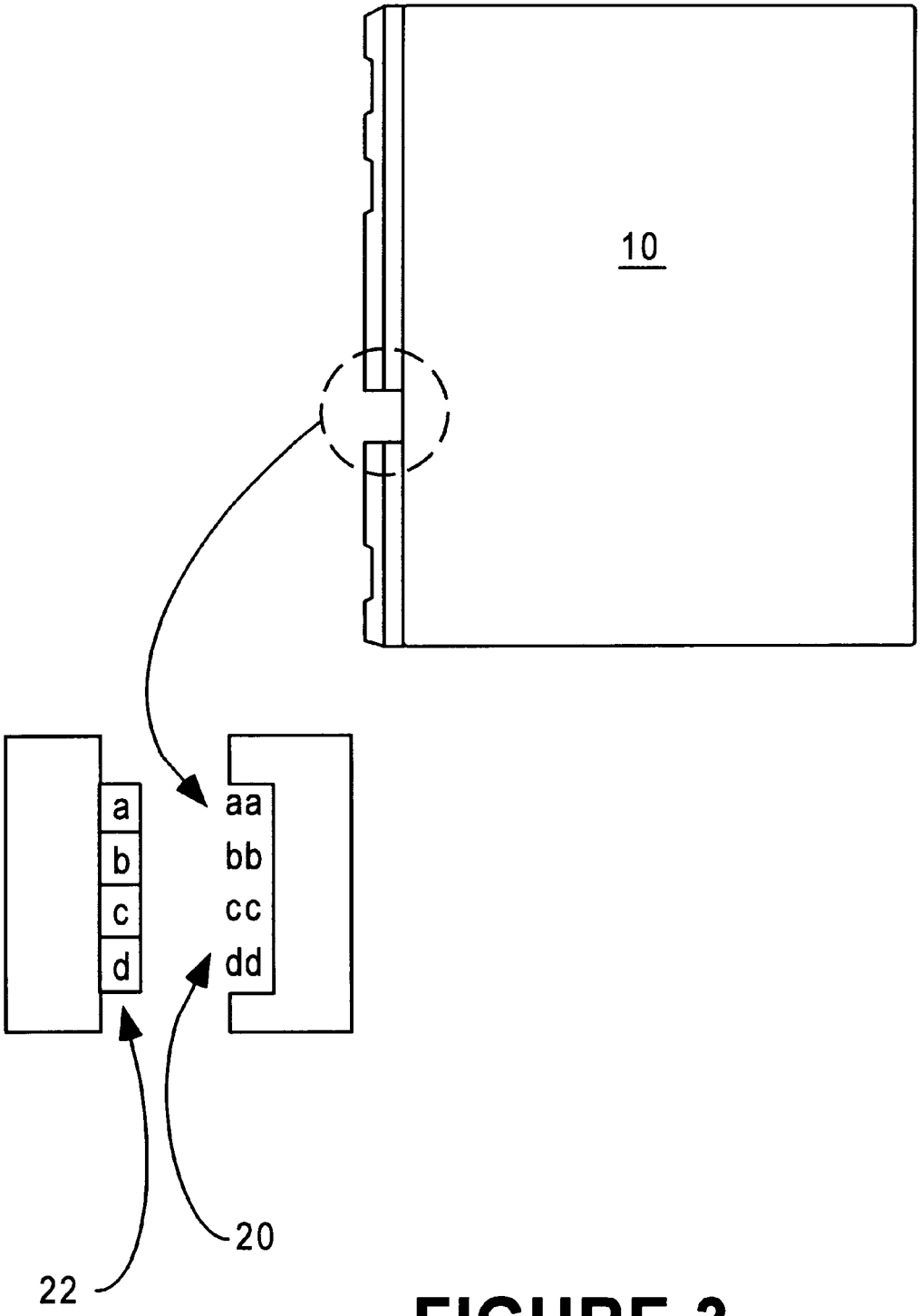
FIG. 3 illustrates the overlapping physical keying for multivoltage host device and expansion card systems.

Turning again to FIG. 1, a female connection 20 is shown provided in connector 14. A corresponding male connection 22 is provided within socket 32 of host device 30. In order to support a variety of voltage key combinations, female connection 20 and male connection 22 are partitioned into four separate segments as shown in FIG. 3. Female connection 20 may be identified by either of segments "aa", "bb", "cc", "dd", or any combination of adjoining segment combinations. The width and location of the female connection 20 along connector 10 is determined by the segment or adjoining segment combinations that are used to define the female connection. As such, the operating voltage or voltages of card 10 may be identified by a variety of notch segment combinations. Likewise, male connection 22 may be identified by either of segments "a", "b", "c", "d", or any combination of adjoining segment combinations. The supply voltage or voltages of host device 30 may be identified by a variety of tab segment combinations. As illustrated in FIG. 3, each of notch segments "aa", "bb", "cc" and "dd" are aligned with and correspond to tab segments "a", "b", "c", and "d", respectively.

Figure 4A:
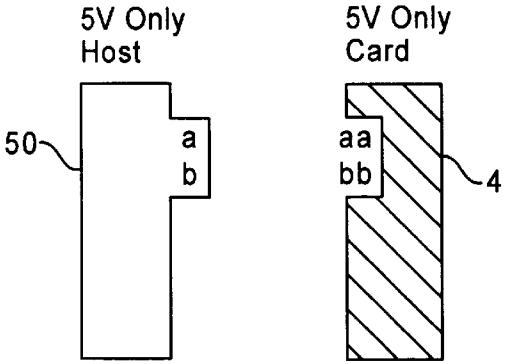
FIG. 4A illustrates a voltage key combination in one embodiment of the present invention.
Figure 4A:
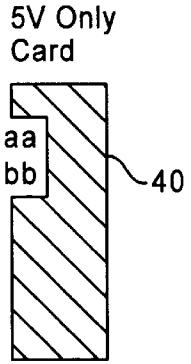
Figure 4B:
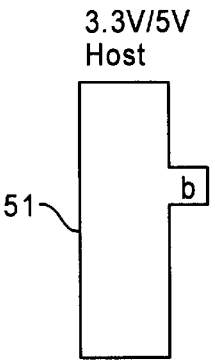
FIG. 4B illustrates a voltage key combination in another embodiment of the present invention.
Figure 4B:
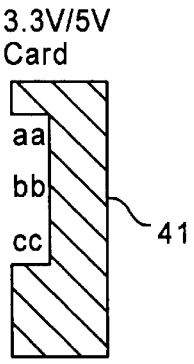
Figure 4C:
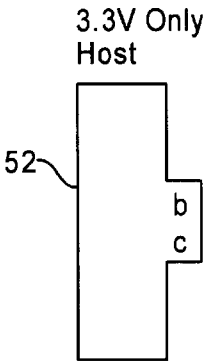
FIG. 4C illustrates a voltage key combination in yet another embodiment of the present invention.
Figure 4C:
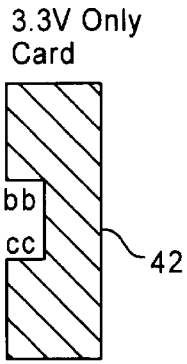
Figure 4D:
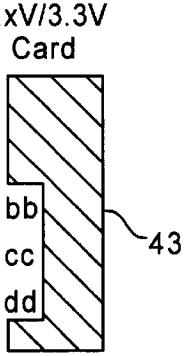
FIG. 4D illustrates a voltage key combination in one embodiment of the present invention.
Figure 4E:
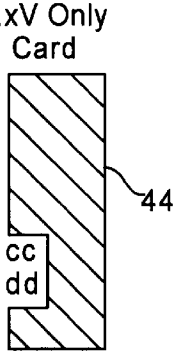
FIG. 4E illustrates a voltage key combination in another embodiment of the present invention.
Figure 4F:
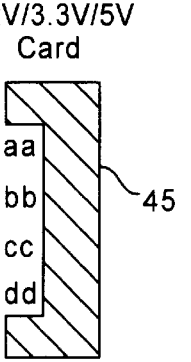
FIG. 4F illustrates a voltage key combination in yet another embodiment of the present invention.

A keyed connection system for a multivoltage system is established by identifying the operating and supply voltages of card 10 and host 30 according to their notch and tab segment locations. FIGS. 4A–4F illustrates an example of a multivoltage system that is capable of supporting up to three different operating voltages. For discussion purposes, the three different operating voltages are 5.0 volts, 3.3 volts and x.x volts. It is appreciated, however, that the present invention may be implemented in a multivoltage system supporting a variety of other operating voltages. In one embodiment, the operating voltage of card 10 may be identified by six different voltage key combinations. In FIG. 4A, an expansion card that operates at only 5.0 volts is identified by connector 40 having notch segments "aa" and "bb". A host that provides only a 5.0 volt supply source is identified by a socket 50 having tab segments "a" and "b". A card that is capable of operating at either 3.3 volts or 5.0 volts is identified by a connector 41 having notch segments "aa", "bb", and "cc". A host that is capable of providing a 3.3 volt or 5.0 volt power supply is identified by a socket 51 having tab segment "b". FIGS. 4C–4F illustrate the notch and tab segment configuration for 3.3 V only, x.xV/3.3V, x.xV only, and x.xV/3.3V/5.0V connectors 42–45 and sockets 52–55. It is important to note that the notch and tab segment configurations illustrated in FIGS. 4A–4F are illustrative of only one manner of identifying the voltage capability of a host or card. Any of a number of other connection schemes may be used in the implementation of the present invention.

The voltage keyed connection system illustrated in FIGS. 4A–4F is capable of providing twenty-six different voltage keyed connections in a multivoltage system supporting three different operating voltages. The twenty-six possible keyed connection combinations are outlined in the table of FIG. 5.

Although a voltage keyed connection system has been described in conjunction with a multivoltage system supporting three different operating voltages, it is understood that the overlapping keying structure described herein may be used in any multivoltage system. This is accomplished by varying the number of notch and tab segments provided within card connector 14 and host socket 32. (See FIG. 3.) Moreover, it is appreciated that the female and male connections of connector 14 and socket 32 may be interchanged. That is, connector 14 may include a male connection and socket 32 may include a female connection.

In one embodiment each notch segment within connector 14 has a width of 1.2 mm and a depth of approximately 2.3 mm. Each corresponding tab segment in socket 32 also has a width of approximately 1.2 mm and a length of 2.3 mm. Generally, the notch of connector 14 and tab of socket 32 are integrally formed as a part of the connector and socket during the molding of the respective parts.

Figure 2:
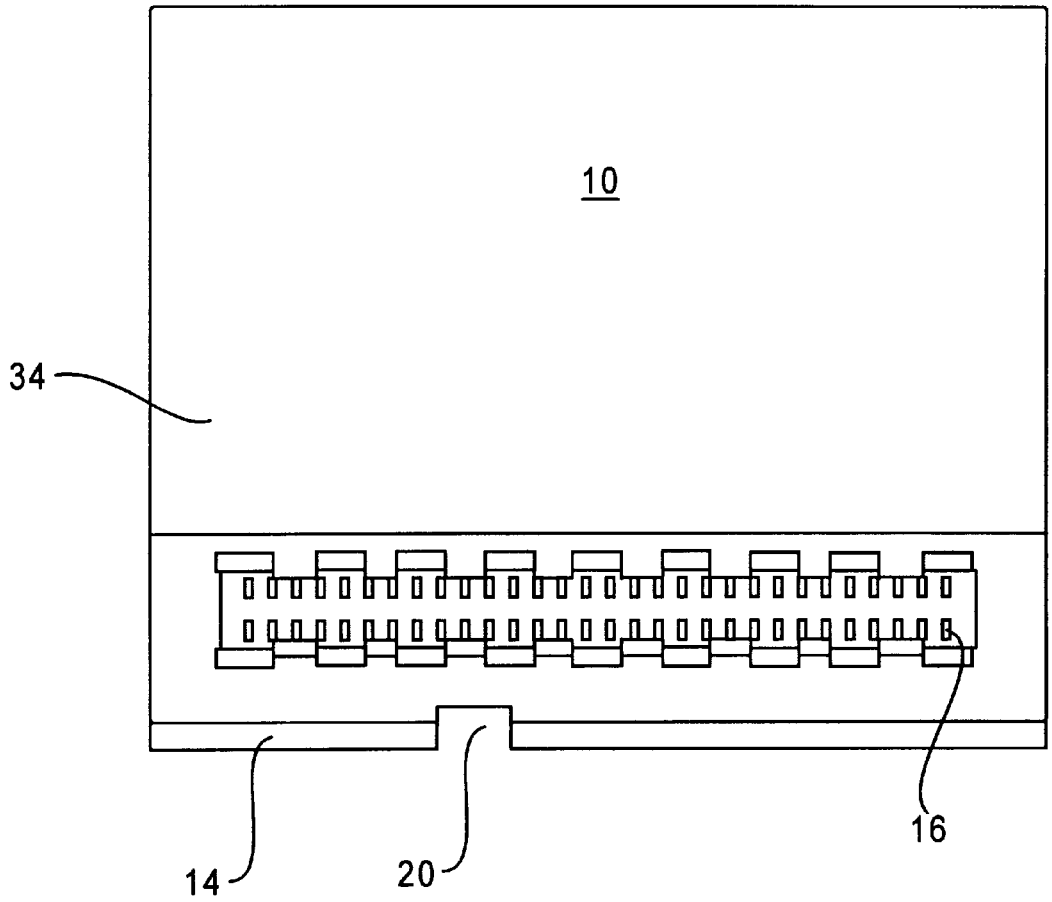
FIG. 2 is a bottom view of an expansion card in one embodiment of the present invention.
Figure 6:
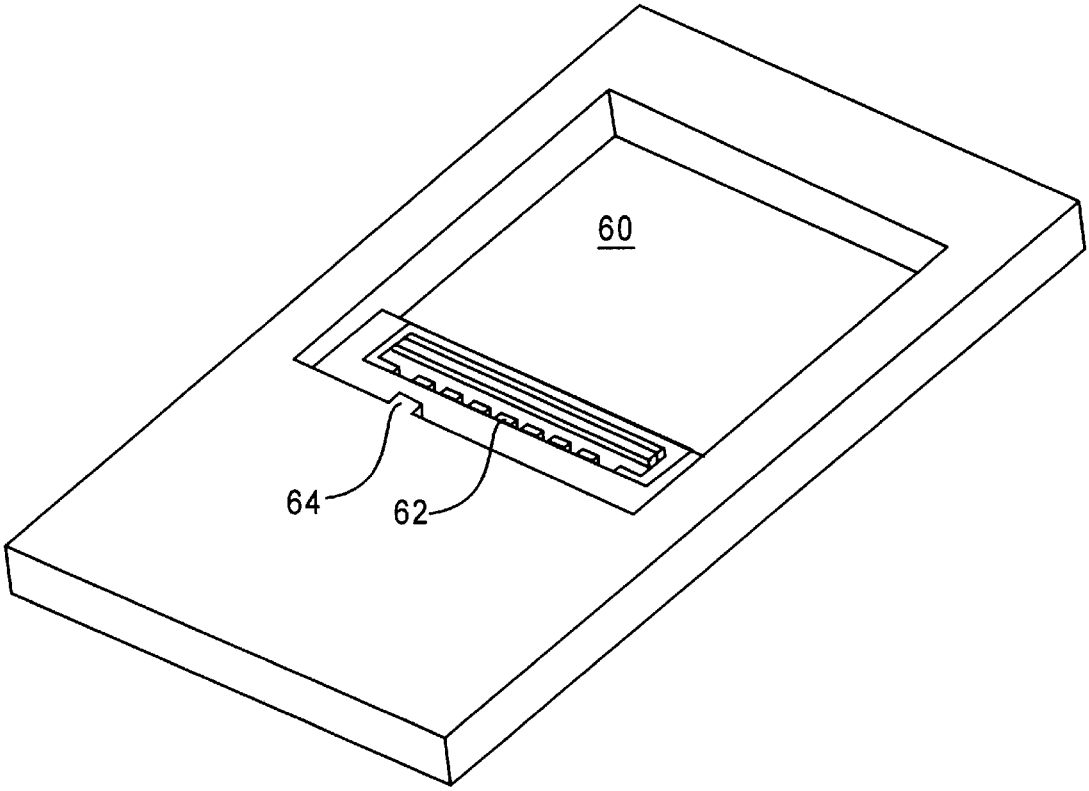
FIG. 6 is a perspective view of a host socket in an embodiment of the present invention.

FIG. 6 shows a perspective view of another socket 60 that may accommodate the card 10 of FIG. 2. Socket 60 includes an elastomeric strip 62 containing a plurality of electrical contacts corresponding to the electrical contacts 16 positioned along the bottom side of card 10. A male connection 64 is disposed within socket 60 for mating with the female connection 20 of card 10.

In the foregoing description a keyed connection system has been described in a multivoltage system comprising a host device and an expansion memory card. The keyed connection system may be used in a variety of other applications that require a physical keying mechanism that prevents the insertion of a peripheral device into a host device that is incapable of supporting the peripheral device.

Thus, a voltage keyed connection system for providing a connection between an expansion card or peripheral device and a host is disclosed. The foregoing specification has been described with reference to specific exemplary embodiments thereof. It will, however, be evident that various modifications and changes may be made thereto without departing from the broader spirit and scope of the invention as set forth in the appended claims. The specification and drawings, accordingly, to be regarded as an illustrative rather than a restrictive sense.

What is claimed is:

1. A connection scheme comprising:

a first host interface providing a first voltage and having a first tab that includes a first tab segment and an adjacent second tab segment, the first tab protruding from a first side of the first host interface, the first tab identifying the first voltage;

a second host interface providing the first voltage and a second voltage and having a second tab that includes the second tab segment only, the second tab protruding from a first side of the second host interface, the second tab identifying the first and second voltages;

a third host interface providing the second voltage and having a third tab that includes the second tab segment and an adjacent third tab segment, the third tab protruding from a first side of the third host interface, the third tab identifying the second voltage;

a first circuit card interface operable at the first voltage, the first circuit card interface having a first notch in a first side of the first circuit card interface, the first notch mateable with the first tab and the second tab;

a second circuit card interface operable at the first and second voltages, the second circuit card interface having a second notch in a first side of the second circuit card interface, the second notch mateable with the first, second and third tabs; and a third circuit card interface operable at the second voltage, the third circuit card interface having a third notch in a first side of the third circuit card interface, the third notch mateable with the second tab and the third tab.

2. The connection scheme of claim 1 wherein:

the first notch includes a first notch segment and an adjacent second notch segment;

the second notch includes the first and second notch segments and a third notch segment adjacent the second notch segment; and the third notch includes the second and third notch segments only.

3. The connection scheme of claim 1 wherein:

the first voltage is 5 volts;

the second voltage is 3.3 volts;

the first circuit card interface is operable at only 5 volts;

the second circuit card interface is operable at 3.3 volts and 5 volts; and the third circuit card interface is operable at only 3.3 volts.

4. The connection scheme of claim 1 further comprising:

a fourth host interface providing the second voltage and a third voltage and having a fourth tab that includes the third tab segment only, the fourth tab protruding from a first side of the fourth host interface, the fourth tab identifying the second and third voltages;

a fifth host interface providing the third voltage and having a fifth tab that includes the third tab segment and an adjacent fourth tab segment, the fifth tab protruding from a first side of the fifth host interface, the fifth tab identifying the third voltage;

a fourth circuit card interface operable at the second and third voltages, the fourth circuit card interface having a fourth notch in a first side of the fourth circuit card interface, the fourth notch mateable with the second, third, fourth and fifth tabs;

a fifth circuit card interface operable at the third voltage, the fifth circuit card interface having a fifth notch in a first side of the fifth circuit card interface, the fifth notch mateable with the fourth tab and the fifth tab; and a sixth circuit card interface operable at the first, second and third voltages, the sixth circuit card interface having a sixth notch in a first side of the sixth circuit card interface, the sixth notch mateable with the first, second, third, fourth and fifth tabs.

5. The connection scheme of claim 4 wherein:

the first notch includes a first notch segment and an adjacent second notch segment;

the second notch includes the first and second notch segments and a third notch segment adjacent the second notch segment;

the third notch includes the second and third notch segments;

the fourth notch includes the second and third notch segments and a fourth notch segment adjacent the third notch segment;

the fifth notch includes the third and fourth notch segments; and the sixth notch includes the first, second, third and fourth notch segments.

6. A connection scheme comprising:

a first circuit card interface operable at a first voltage, the first circuit card interface having a first notch in a first side of the first circuit card interface, the first notch including a first notch segment and an adjacent second notch segment, the first notch identifying the first voltage;

a second circuit card interface operable at the first voltage and a second voltage, the second circuit card interface having a second notch in a first side of the second circuit card interface, the second notch including the first and second notch segments and a third notch segment adjacent the second notch segment, the second notch identifying the first voltage and the second voltage; and a third circuit card interface operable at the second voltage, the third circuit card interface having a third notch in a first side of the third circuit card interface, the third notch including the second and third notch segments, the third notch identifying the second voltage.

7. The connection scheme of claim 6 further comprising a fourth circuit card interface operable at the second voltage and a third voltage, the fourth circuit card interface having a fourth notch in a first side of the fourth circuit card interface, the fourth notch including the second and third notch segments and a fourth notch segment adjacent the third notch segment, the fourth notch identifying the second and third voltages.

8. The connection scheme of claim 7 further comprising a fifth circuit card interface operable at the third voltage, the fifth circuit card interface having a fifth notch in a first side of the fifth circuit card interface, the fifth notch including the third and fourth notch segments, the fifth notch identifying the third voltage.

9. The connection scheme of claim 8 further comprising a sixth circuit card interface operable at the first, second and third voltages, the sixth circuit card interface having a sixth notch in a first side of the sixth circuit card interface, the sixth notch including the first, second, third and fourth notch segments, the sixth notch identifying the first, second and third voltages.

10. A connection scheme comprising:

a first host interface providing a first voltage and having a first tab that includes a first tab segment and an adjacent second tab segment, the first tab extending from a first edge of the first host interface, the first tab identifying the first voltage;

a second host interface providing the first voltage and a second voltage and having a second tab that includes only the second tab segment, the second tab extending from a first edge of the second host interface, the second tab identifying the first and second voltages; and a third host interface providing the second voltage and having a third tab that includes the second tab segment and an adjacent third tab segment, the third tab extending from a first edge of the third host interface, the third tab identifying the second voltage.

11. The connection scheme of claim 10 further comprising a fourth host interface providing the second voltage and a third voltage and having a fourth tab that includes only the third tab segment, the fourth tab extending from a first edge of the fourth host interface, the fourth tab identifying the second and third voltages.

12. The connection scheme of claim 11 further comprising a fifth host interface providing the third voltage and having a fifth tab that includes the third tab segment and an adjacent fourth tab segment, the fifth tab extending from a first edge of the fifth host interface, the fifth tab identifying the third voltage.

* * * * *